United States Patent [19]

Paton et al.

[11] 4,121,647

[45] Oct. 24, 1978

[54] METHOD OF PRODUCING A MULTILAYER METAL INGOT BY THE ELECTRO-BEAM REMELTING OF BILLETS

[76] Inventors: Boris Evgenievich Paton, ulitsa Chkalova, 41a, kv. 26; Boris Alexeevich Movchan, ulitsa Darvina, 7, kv. 7; Jury Anatolievich Kurapov, ulitsa Semashko, 8, kv. 44; Rostislav Spiridonovich Misjura, ulitsa Chudnovskogo, 2, kv. 22, all of Kiev; Igor Stepanovich Pryanishnikov, ulitsa Koreshkova, 12, kv. 8, Elektrostal Moskovskoi oblasti; Vladimir Nikiforovich Zhuchin, ulitsa Pervomaiskaya, 48, kv. 43, Elektrostal Moskovskoi oblasti; Valentin Vasilievich Topilin, ulitsa Mira, 6, kv. 29, Elektrostal Moskovskoi oblasti; Igor Vasilievich Perepelitsa, ulitsa Tevosiana, 37, kv. 39, Elektrostal Moskovskoi oblasti, all of U.S.S.R.

[21] Appl. No.: 686,514

[22] Filed: May 14, 1976

[30] Foreign Application Priority Data

May 22, 1975 [SU] U.S.S.R. ..... 2136106[I]
May 22, 1975 [SU] U.S.S.R. ..... 2136107[I]

[51] Int. Cl.[2] ..... B22D 27/02
[52] U.S. Cl. ..... 164/50; 164/250
[58] Field of Search ..... 164/50, 250

[56] References Cited

U.S. PATENT DOCUMENTS

| | | | |
|---|---|---|---|
| 3,237,254 | 3/1966 | Hanks et al. | 164/50 |
| 3,342,250 | 9/1967 | Treppschuh et al. | 164/50 |
| 3,528,484 | 9/1970 | Scharf et al. | 164/50 X |
| 3,749,149 | 7/1973 | Paton et al. | 164/250 X |

FOREIGN PATENT DOCUMENTS 1,224,881 3/1970 Fed. Rep. of Germany.

*Primary Examiner*—Robert L. Spicer, Jr.
*Attorney, Agent, or Firm*—Lackenbach, Lilling & Siegel

[57] ABSTRACT

A method of producing a multilayer ingot in an electron-beam installation, with the billet arranged in a base plate above the bottom thereof, and the base plate is reciprocated in a horizontal direction as said billet is being melted and the first layer of said ingot is being shaped. Another metal billet is melted above an intermediate vessel, with the molten metal being poured thereoff onto said first layer of the ingot in the base plate forming thereby a second layer on the first formed layer and additional layers of a multilayer ingot are shaped in a similar manner. The reciprocation speed of the base plate is inversely proportional to the cooling rate of the ingot metal in a longitudinal direction. The method of the invention ensures producing ingots with a smooth surface which does not require and preprocessing prior to rolling.

3 Claims, 2 Drawing Figures

Figure 1:
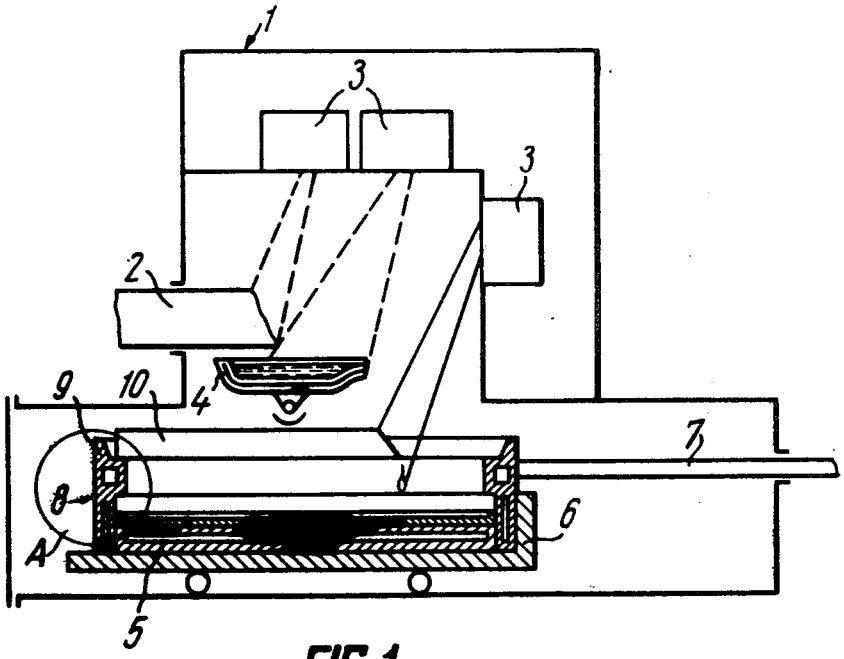

METHOD OF PRODUCING A MULTILAYER METAL INGOT BY THE ELECTRO-BEAM REMELTING OF BILLETS

The present invention relates to electrometallurgy and more particularly to a method of remelting metal ingots in an electron-beam installation that has been improved appropriately for effecting said method.

The present invention may prove to be most advantageous when producing bimetallic ingots made up of layers with a smooth surface, each of said layers having essentially the same thickness all along its length.

Nowadays known in the prior art is a plurality of various methods for producing bimetallic ingots and of installations for realizing said methods. Thus, widely known are the procedures envisaging the pouring of molten metal onto a solid metal plate placed in a mould, or onto a solid ingot component (without resorting to a mould). According to some of these methods, two molten metals are poured one after another in one and the same mould or a molten metal is poured through a clearance between two moving hot metal strips. (see S. A. Golovanenko, L. V. Meandrov. "Production of Bimetals", "Metallurgia" Publishers, 1966, pp. 160–169).

However, in the case of producing a multilayer metal ingot an oxide film is formed on the surface of an ingot component that has been poured first (a bottom layer) upon its solidifying. Said film can be also formed on the surface layer of the ingot if the prescribed temperature conditions are not observed sufficiently accurately when melting said multilayer metal ingot. The presence of said film in a bimetallic ingot may be responsible for rejects to laminations during the subsequent rolling of said ingot.

The Inventor's Certificate of the USSR No. 302954 teaches a method of making or forming a multilayer metal ingot, wherein the first metal billet is melted in the intermediate vessel of an electronbeam installation.

Next molten metal is poured from said intermediate vessel into a base plate having an enclosure arranged transversely to the direction of transfer of said base plate. The latter is carried in a horizontal direction as it is being filled with the molten metal. Thus, while shaping the first layer of the multilayer metal ingot the base plate is transferred with respect to both the enclosure and intermediate vessel, whereupon the enclosure is lifted to a height equal to the thickness of the first layer of the ingot being produced and the base plate is returned to its initial position. The processes of remelting the mext metal billet and shaping the next layer of said multilayer metal ingot thereof are accomplished in a similar manner.

Said method is effected in the vacuum chamber of an electron-beam installation, the formation of oxide films while melting multilayer metal ingots being thereby avoided.

However, when producing multilayer metal ingots of metals with different linear expansion (thermostat metals), heating with the aid of a movable thermal zone leads to the distortion (wraping) of the bottom layer of said multilayer ingot. As a result, the molten metal of the second layer leaks under the solidified first layer with the ensuing variations in the thickness of said layer along its length and the occurence of irregularities on the lower surface of the multilayer ingot.

The remelting of the first metal billet above the intermediate vessel, as well as the subsequent pouring of the molten metal thereoff into the base plate are accompanied by metal losses both in the intermediate vessel and in the base plate.

Moreover, the pouring of the first batch of the molten metal from the intermediate vessel onto the cold bottom of said base plate causes sputtering of said molten metal, with the sputters freezing solid, which precludes obtaining a smooth lower surface of said ingot.

All this create considerable difficulties in making or forming high-quality multilayer metal ingots.

The Inventor's Certificate of the USSR No. 302964 protects an electron-beam installation for producing multilayer metal ingots, comprising a vacuum chamber with a device for feeding therein metal billets to be remelted above an intermediate vessel under the effect of beams generated by electron guns.

To enable the shaping of a multilayer ingot said installation comprises also a base plate mounted on a carriage that is transferred in a horizontal direction. The base plate has vertical walls with a flat internal surface and with an enclosure being transferred with respect to said walls in a vertical direction.

Said installation is well adaptable for effecting the above-outlined method protected by the Inventor's Certificate of the USSR No. 302954.

However, though superior in certain respects to the similar prior-art plants, said installation is not able to eliminate the warping of the ingot layers and variations in their thickness along the length of the ingot and, hence, it does not guarantee the production of high-quality multilayer metal ingots.

In view of ever growing requirements for the quality of multilayer ingots being melted there is a need for improving substantially the prior-art installations and working out a novel method ensuring the production of high-quality multilayer metal ingots.

The main object of the present invention is to provide a method of remelting metal ingots in an electron-beam installation, which would make it possible to rule out the distortion and thickness variations along the metal layers making up the desired multilayer ingot in the course of its production.

Another no less important object of the invention is the provision of an electron-beam installation which would ensure the making or forming of high-quality multilayer metal ingots by eliminating the distortion of their layers and improving the quality of the surface of said ingot.

Still another important object of the invention is to cut down metal losses.

Yet another object of the invention is to eliminate the sputtering of the first batch of metal and to provide the smooth lower surface of an ingot that would not require any preprocessing before rolling.

These and other objects of the invention are achieved by providing a method of melting a metal ingot in an electron-beam installation, said method comprising the steps of melting metal billets above an intermediate vessel and pouring molten metal thereoff into a base plate that is transferred in a horizontal direction with respect to said intermediate vessel as the layers of a multilayer ingot are being shaped alternately, the first metal billet being remelted, according to the invention, directly in the base plate and being arranged with a clearance with respect to the bottom of said base plate.

This allows decreasing metal losses and precluding its sputtering, a feature that contributes to the production of multilayer ingots with a high-quality smooth lower surface.

It is advisable if the first metal billet is made flat and placed on the top end face wall sections of the base plate, whereupon the latter (the base plate) would be transferred, as said billet is being fused and the first layer of said multilayer ingot is being shaped.

This simplifies the solution of the problem of producing the first high-quality bottom layer of said ingot.

It is expedient that while shaping each layer of a multilayer ingot that the base plate reciprocate with a speed that is inversely proportional to a lengthwise rate of cooling of the ingot metal.

This precludes distortion of the layers and variations in thickness along the length of each of the metal layers making up said multilayer ingot and, consequently, ensures the production of high-quality ingots.

An electron-beam installation that has been provided for realizing said method comprises a vacuum chamber with electron-beam guns for melting metal billets above an intermediate vessel mounted tiltably with respect to a horizontal axis above the base plate which is fitted with a horizontal transfer drive. The walls of said base plate are made detachable and are provided with a bead running along the external perimeter of their top end face sections, and with shoulders, each of which extends along the entire perimeter of the internal surface of said walls, reducing thereby said perimeter upwardly. The number of said shoulders being equal to that of the next layers of the multilayer metal ingot, and the width of each shoulder amounting to the thickness of an opposite layer and the height of said shoulders exceeding half the linear shrinkage of an underlying layer during its cooling.

Said electron-beam installation, comprising the base plate, is adaptable for effecting the herein-proposed method. The bead provided on the top end face sections of the walls precludes metal leakage from the first flat (sheet) billet, while the shoulders on the internal sides of the base plate walls obviate the leaking of the molten metal of the second layer of said multilayer ingot under the first bottom layer, which promotes the melting of high-quality ingots with a smooth lower surface and with the layers having the same thickness along the length of the ingot.

Figure 2:
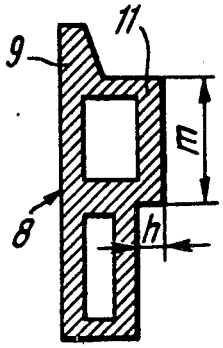

The nature of the invention will be clear from the following detailed description of various embodiments of the novel method and an installation with a base plate to be considered in conjunction with the accompanying drawings, in which:

FIG. 1 is a longitudinal sectional view of an installation according to the invention; and FIG. 2 is a greatly enlarged sectional view of the base plate (see reference A), in FIG. 1.

An electron-beam installation for melting multilayer metal ingots comprises a vacuum chamber 1 (FIG. 1) for melting metal billets 2 under the effect of one or more beams of electron guns 3. The melting is accomplished above a water-cooled intermediate vessel 4 or directly in a water-cooled base plate 5 adaptable for shaping multilayer metal ingot in layers. The intermediate vessel 4 is pivotably secured with respect to a hroizontal axis and is fitted with a gear (not shown in the drawing) for pivoting said vessel so as to pour molten metal therefrom into said water-cooled base plate 5.

The water-cooled base plate 5 is mounted on a carriage 6 having a connecting rod 7 that is linked mechanically with a horizontal reciprocating drive (not shown in the drawing). Walls 8 of the base plate 5 of the detachable construction are watercooled. To preclude the runoff of molten metal outwards when melting the first metal flat billet 10 (FIG. 1) that is placed on the top end faces of the walls 8 of the base plate 5, the walls 8 are provided with a bead 9 (FIG. 2) running along the external perimeter of the top end face wall sections. Moreover, the walls 8 have shoulder 11 extending on their internal surface along the entire perimeter. The space between the shoulder 11 and the bottom of the base plate 5 is to be filled with the molten metal forming the first layer of the ingot, said spacing between the above shoulder 11 and the bottom of the base plate 5 being, consequently, determined by the preset thickness of said layer. The width ($m$) of the shoulder 11 is equal to the thickness of an opposite (second) layer. As to the height ($h$) of the shoulder (11), it must exceed half the linear shrinkage of the metal of the underlaying (first) layer upon its cooling.

The walls 8 can be provided with a plurality of such shoulder 11 (not shown in the drawings), their number being the function of the prescribed number of the next (second, third, etc.) layers located above the first layer in a multilayer ingot, and each shoulder 11, disposed above the preceding one, decreasing the perimeter of the walls 8 of the base plate 5 in a vertical direction (upwards).

The method, according to the invention, is realized in the proposed electron-beam installation in a following manner.

For shaping the first layer of a multilayer metal ingot preferably a flat billet 10 is taken and placed with a clearance on the bottom of the base plate 5 by laying it, e.g., on the top shoulder 11 or on the top end face sections of the walls 8 of the base plate 5. The metal flat billet 10 is melted under the effect of the beams generated by the electron guns 3, the base plate 5 being transferred as the first metal billet 10 is being fused and the first layer of said multilayer ingot is being shaped thereof.

While melting the first metal billet 10 the bead 9 on the walls 8 keeps the molten metal from running off onto the external surface of the walls 8. The melting of the first metal billet 10 directly in the base plate 6 precludes the sputtering of the molten metal and diminishes materially metal losses (burnout).

Moreover, the molten metal is heated on the bottom of the base plate 5 by the beams of said electron guns so that the same temperature and aggregate state are maintained at its surface. This is attained by reciprocating the base plate with a speed that is inversely proportional to the metal cooling rate of the ingot layer in a longitudinal direction. During the subsequent cooling of the metal layer the first layer of said multilayer metal ingot is crystallized on the bottom of the base plate 5. The edges of the first layer of the ingot happen to be arranged under the shoulder 11 on the walls 8, a feature precluding their distortion and leakage of the molten metal thereunder while pouring the second layer of the ingot (the second component of a bimetal).

For shaping the ingot second layer the metal billet 2 is melted under the effect of the beams of the electron guns 3 above the intermediate vessel 4. The molten metal flows into the intermediate vessel 4 where it is also heated by said beams of the electron gun 3.

Upon accumulating the molten metal in the intermediate vessel 4, the latter is tilted and the molten metal runs off into the base plate 5 onto the first crystallized layer. At the same time as the second layer of the metal ingot is being shaped thereon, the base plate 5 is reciprocating in a horizontal direction.

Said motion of the base plate 5 accompanied by the heating of the external surface of the second layer of said ingot creates favorable conditions for the soldification of the ingot.

During subsequent melting of the billet 2 the intermediate vessel 4 remains in a tilted position, the molten metal running continuously therefrom into the base plate 5. After the first batch of the molten metal, sufficient to shape the second layer of the ingot, has run off into the base plate 5, the temperature at the metal surface is reduced gradually and simultaneously over the entire area of said layer in the course of its solidification.

The second shoulder is adapted for registering in position the end portions of the second layer of said ingot during its crystallization and for precluding the leakage of the molten metal thereunder when building-up the third layer of the ingot. The next layers are produced similarly to the second one. The ready ingot is taken out of the base plate 5 by removing its detachable walls 8.

The possibility of melting high-quality multilayer metal ingots according to the present invention was borne out by tests.

We claim:

1. A method of producing a multilayer ingot in an electron beam-installation, comprising the steps of remelting a first metal billet, positioned directly in a base plate, by means of electron-beams for producing a first layer of said multilayer ingot, said billet being arranged with a clearance with respect to the bottom of said base plate; reciprocating said base plate as said billet is being melted and collected therein so as to form said first layer of said ingot; electron-beam remelting another metal billet above an intermediate vessel disposed above said reciprocating base plate and pouring accumulated molten metal thereoff into said base plate so as to form and shape one or more additional layers of said multilayer ingot therein, and reciprocating said base plate in a horizontal direction with respect to said intermediate vessel at a speed that is inversely proportional to the cooling rate of the ingot metal in a longitudinal direction, whereby the surface quality is improved, the thickness of said layers along the length of said ingot are uniform, and distortion of said layers is avoided, thereby precluding the need for additional processing of said ingot prior to rolling.

2. The method of claim 1, wherein said layers form a bimetallic ingot.

3. The method of claim 1, wherein the thickness of each of said layers is approximately the same over the entire area of said multilayer ingot.

* * * * *